US009926107B2

(12) United States Patent
Koesters et al.

(10) Patent No.: US 9,926,107 B2
(45) Date of Patent: Mar. 27, 2018

(54) SIDE-GUSSET BAG MADE OF A PLASTIC FILM/FABRIC LAMINATE

(71) Applicant: MONDI Halle GmbH, Halle (DE)

(72) Inventors: Jens Koesters, Wallenhorst (DE); Jochen Brauer, Lohne (DE)

(73) Assignee: MONDI HALLE GMBH, Halle (DE)

( * ) Notice: Subject to any disclaimer, the term of this patent is extended or adjusted under 35 U.S.C. 154(b) by 0 days.

(21) Appl. No.: 15/382,620

(22) Filed: Dec. 17, 2016

(65) Prior Publication Data

US 2017/0096262 A1 Apr. 6, 2017

Related U.S. Application Data

(63) Continuation-in-part of application No. 14/474,431, filed on Sep. 2, 2014, now abandoned.

(30) Foreign Application Priority Data

Sep. 4, 2013 (DE) ..... 10 2013 109 656
Aug. 7, 2014 (EP) ..... 14180177

(51) Int. Cl.

| | |
|---|---|
| ***B65D 33/24*** | (2006.01) |
| ***B65D 30/20*** | (2006.01) |
| ***B65D 30/08*** | (2006.01) |
| ***B65D 33/01*** | (2006.01) |
| ***B65B 7/02*** | (2006.01) |
| ***B65B 1/04*** | (2006.01) |

(52) U.S. Cl.

CPC ..... *B65D 31/10* (2013.01); *B65B 1/04* (2013.01); *B65B 7/02* (2013.01); *B65D 29/02* (2013.01); *B65D 33/01* (2013.01)

(58) Field of Classification Search

CPC ..... B65D 31/04; B65D 31/08; B65D 31/10; B65D 29/02

See application file for complete search history.

(56) References Cited

U.S. PATENT DOCUMENTS 3,507,443 A * 4/1970 Gerard ..... B65D 31/02 229/5.82
3,535,184 A * 10/1970 Schwartz ..... B29C 65/04 156/157
4,044,180 A * 8/1977 Baker ..... B32B 27/12 383/210
4,373,979 A * 2/1983 Planeta ..... B29C 66/1122 156/217
6,286,681 B1 * 9/2001 Wilfong, Jr. ..... B65D 33/001 206/554

(Continued)

*Primary Examiner* — Derek Battisti
(74) *Attorney, Agent, or Firm* — Andrew Wilford

(57) ABSTRACT

A side-gusset bag made of a plastic film/fabric laminate has front and rear panels formed of the laminate. Side gussets between the front panel and the rear panel, each formed with a pair of flanks meeting at a center fold, and each connected to the front panel and rear panel at respective edge folds. A lower end flap of the front panel and the flanges between the front panel and the rear panel having respective lower edges that are stepped to form exposed lower edge regions covered with glue such that, when folded rearward along a lower edge of the rear panel, the glue on these lower edge regions directly engages a rear face of the rear panel and secures the lower edge regions to the rear panel to form a bottom gusset.

6 Claims, 4 Drawing Sheets

(56) References Cited

U.S. PATENT DOCUMENTS

| | | | | |
|---|---|---|---|---|
| 6,413,377 | B1 * | 7/2002 | Wright | D21F 1/0036 139/383 A |
| 6,461,043 | B1 * | 10/2002 | Healy | B65D 33/2591 383/103 |
| 6,526,730 | B2 * | 3/2003 | Koehn | B29C 65/08 53/370 |
| 7,510,327 | B2 * | 3/2009 | Williams | B65F 1/0006 383/113 |
| 7,731,425 | B2 * | 6/2010 | Lin | B65D 31/02 383/117 |
| 2007/0082158 | A1 * | 4/2007 | Nowak | B32B 5/024 428/36.1 |
| 2011/0019943 | A1 * | 1/2011 | Piraneo | B65D 31/10 383/104 |
| 2016/0176579 | A1 * | 6/2016 | Brauer | B31B 19/00 383/10 |

* cited by examiner

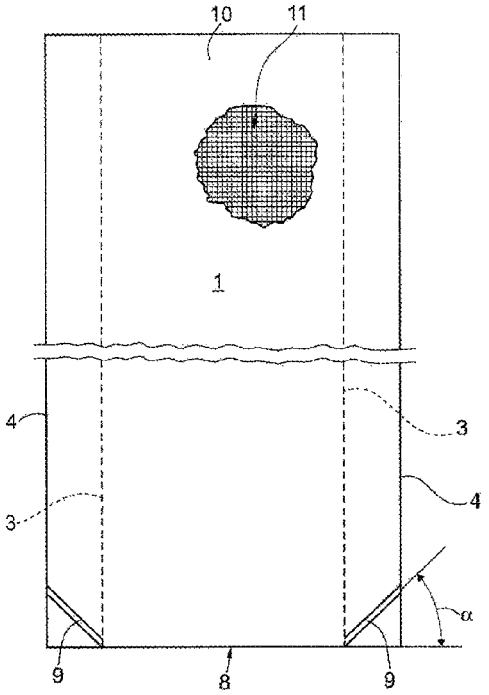
Fig. 1
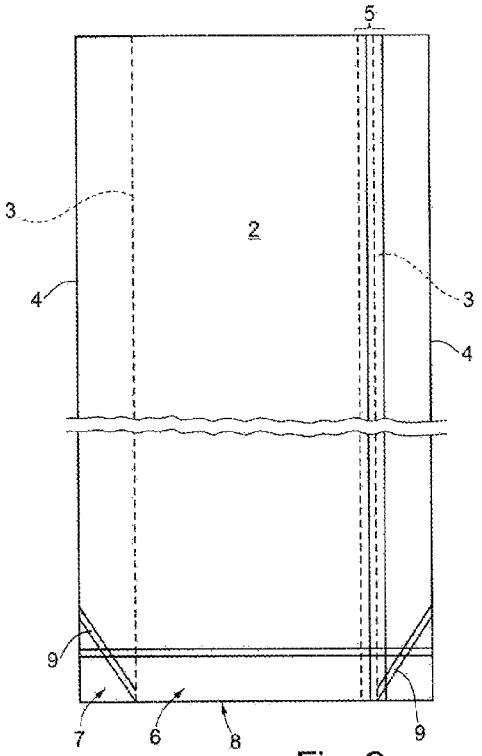
Fig. 2
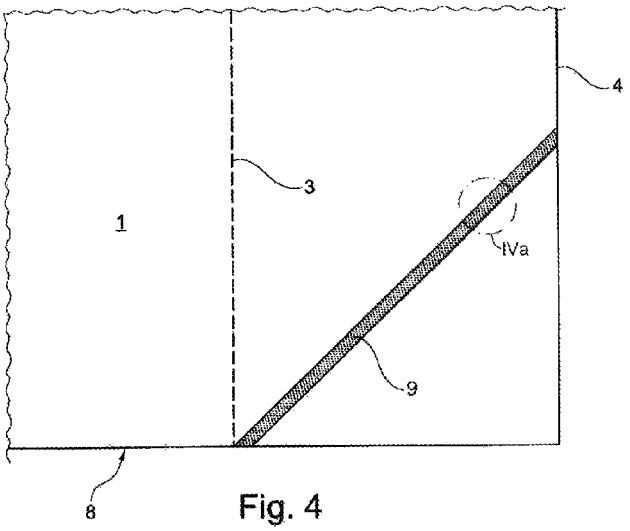
Fig. 4
Fig. 3
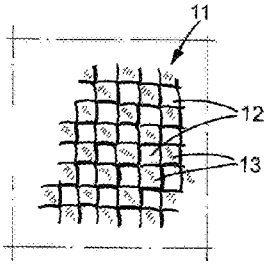
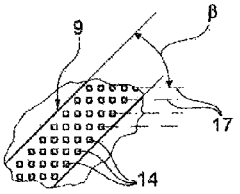
Fig. 4a

SIDE-GUSSET BAG MADE OF A PLASTIC FILM/FABRIC LAMINATE

CROSS REFERENCE TO RELATED APPLICATIONS

This application is a continuation-in-part of copending application Ser. No. 14/474,431 files 2 Sep. 2014 with a claim to the priority of German application 10 2013 109 656.5 filed 4 Sep. 2013 and European 14 180 177.9 filed 7 Aug. 2014.

FIELD OF THE INVENTION

The present invention relates to a side-gusset bag. More particularly this invention concerns such a bag made from a laminate of plastic film and fabric.

BACKGROUND OF THE INVENTION

A typical side-gusset bag has a front panel, a rear panel, and side gussets between the front panel and the rear panel and connected to the front and rear panels by respective edge folds. The side-gusset bag is made of a plastic film/fabric laminate that comprises a polymer film on the outer surface of the bag and fabric connected to the polymer film and made of polymer ribbons on the inner surface of the bag. The fabric and the polymer film on the outer surface of the bag are connected flatly to each other and form a fixed plastic film/fabric laminate. The side-gusset bag that lies flat is closed on one end by a lower end flap of the front panel, and side-gusset flaps between the flap of the front panel and the rear panel and folded onto the rear panel to form a bottom gusset and connected thereto. The front and rear panels form surfaces of equal size. The designation of these bag surfaces as "front panel" and "rear panel" is intended to facilitate understanding of the teaching according to the invention, and not to present any technical restriction. For the purpose of facilitating understanding of the technical teaching as claimed, in the scope of the disclosure of the invention, the bag surface onto which film flaps are folded and attached, thereby forming the bottom gusset, is termed the "rear panel."

The flattened side-gusset bag can be filled through the open end thereof, and is closed following filling. The filled side-gusset bag is configured as a packaging bag, particularly for loose fill materials such as pelletized animal feed, litter for animals, or similar materials. As a result of the use of a plastic film/fabric laminate, the side-gusset bag is particularly suitable for large packages that have a significant filled volume and a significant filled weight. Corresponding side-gusset bags are also termed "side fold bags" in practice. No differentiation is made between these two terms in the context of the present invention.

Side-gusset bags made of single- or multi-layer films not reinforced by a fabric typically have a bottom face formed by welds. The welds extend from a edge fold on longitudinal sides of the front or rear panels, at an acute angle, toward the bottom gusset. The welds, also termed "corner seals", function such that the base of the side-gusset bag better forms a flat bottom face when the side-gusset bag is filled with a product.

In practice, side-gusset bags manufactured from a plastic film/fabric laminate do not have any welds to shape the base, because the fabric surface on the inner surface of the bag cannot be welded, or cannot be welded well. High welding temperatures are necessary to produce a weld, and there is the risk that the polymer structure and the orientation of the polymer ribbons of the fabric will be destroyed by to much heat. A further problem in the creation of welds between the flanks of the side gussets and the adjacent front panel or rear panel is the poor contact between the surfaces being connected, due to their fabric structure. Side-gusset bags made of plastic film/fabric laminate materials, and without corner seals on the bottom face, have a base shape that is visually poor following filling. The poor base shape also has negative influences on the volume of the container, because the fill height increases if the base does not sit correctly. This then needs to be taken into account by increasing the height of the bag. The problem occurs particularly in the case of side-gusset bags that lie flat, and have deep side gussets that form rectangular packages after filling.

In order to make it possible to create welds on side-gusset bags manufactured from a plastic film/fabric laminate, the fabric must be equipped over its entire surface or at least sectionally with a coating capable of producing a weld—produced by way of example by an extrusion coating or by the application of a hot-melt glue. The use of coated fabrics made of uniaxially oriented polymer ribbons, and a coating made of a sealable polymer, for the purpose of producing bags, is known from US 2010/0209024. The coating of the fabric surface of a plastic film/fabric laminate material, for the purpose of improving the seal properties, involves a complex manufacturing process, and requires an additional application of material that involves accordingly higher costs.

The practice of connecting a fabric made of polymer ribbons to a polymer surface, by ultrasound welding, is known from U.S. Pat. No. 4,373,979. The fact that the ultrasound welding method can be used to close the end of the film tube is described using the example of a side-gusset bag. The weld points produced by ultrasound welding are in multiple rows that extend perpendicularly to the longitudinal direction of the film tube. In this case, the distance between the weld points is selected such that each polymer ribbon of the fabric is captured by one weld point.

OBJECTS OF THE INVENTION

It is therefore an object of the present invention to provide an improved side-gusset bag made of a plastic film/fabric laminate.

Another object is the provision of such an improved side-gusset bag made of a plastic film/fabric laminate that overcomes the above-given disadvantages, in particular that has a flat and stable bottom face after being filled.

SUMMARY OF THE INVENTION

A side-gusset bag made of a plastic film/fabric laminate has front and rear panels formed of the laminate, which has a polymer film on an outer surface of the bag and a fabric connected to the polymer film and made of polymer ribbons on an inner surface of the bag. Side gussets between the front panel and the rear panel are each formed of the laminate with a pair of flanks meeting at a center fold, and are each connected to the front panel and rear panel at respective edge folds. A lower end flap of the front panel and the flanges between the front panel and the rear panel have respective lower edges. A lower edge of the lower end flap of the front panel, the lower edges of the flanks of the side gussets adjacent the front panel, the lower edges of the flanks of the side gussets adjacent the rear panel, and a lower edge of the rear panel are offset with respect to each other and form adjacent exposed edge strips or regions. Glue is provided on the lower edge regions of the flanks and lower end flap such that, when folded rearward along a lower edge of the rear panel, the glue on these lower edge regions directly engages a rear face of the rear panel and secures the lower edge regions to the rear panel to form a bottom gusset. Corner weld seams bond the fabric surfaces of the side gussets on the inner surface of the bag to the adjacent fabric surfaces of the front panel or rear panel and extend at an acute angle toward the bottom gusset.

The fabric and the polymer film are connected to each other and form a fixed laminate. The fabric is untreated and does not comprise a sealable coating on the inner surface of the bag. According to the invention, the fabric surfaces of the side gussets on the inner surface of the bag are connected to the adjacent fabric surfaces of the front panel or rear panel by corner weld seams that extend at an acute angle from a edge fold on longitudinal sides of the front or rear panels toward the bottom gusset. It is essential to the invention that the corner weld seams have a structure generated by ultrasound welding with a grid pattern consisting of a plurality of punctiform or linear weld points. A grid pattern made of a plurality of weld points one behind and adjacent to each other is advantageous. As a result of a local connection at a plurality of weld points or lines oriented for example parallel to or across each other, the strength of the seam of the corner weld seams is the same in the longitudinal and transverse directions of the corner weld seams. Specifically, no significant brittleness arises at the seam edges of the corner weld seams, as can often be observed in the case of heat seals of polymer films produced using hot weld tongs.

The corner welds advantageously extend up to the bottom gusset. In this case, the corner weld seams are oriented in such a manner that they form an angle between 30° and 60° with the bottom gusset. According to one preferred embodiment of the invention, the corner weld seams each enclose a equilaterally triangular surface together with the bottom gusset and one edge fold on the side.

The fabric of the plastic film/fabric laminate can particularly consist of a mesh of ribbon-shaped polymer strips. The polymer ribbons of the mesh preferably have a width between 2 mm and 5 mm longitudinally and the transverse direction of the bag such that the polymer strips of the mesh, extending longitudinally and the transverse direction of the bag can also particularly have substantially the same width.

The corner weld seams are advantageously 2 mm to 10 mm wide and the grid pattern can have 10 to 500 weld points per surface area of 100 $mm^2$. The weld points of the corner weld seams are preferably on parallel lines oriented at an angle of 45° with respect to the longitudinal extension of the corner weld seams. In this case, at least three weld points are on each line, next to each other with equidistant spacing.

The plastic film/fabric laminate is typically made of polyolefinic components, and the polymer film on the inner surface of the bag is preferably a polypropylene film and particularly consists of a biaxially oriented polypropylene (BOPP). As an alternative, the polymer film on the inner surface of the bag can consist of a polyester or polyamide (OPET, OPA). The fabric on the inner surface of the bag comprises uniaxially oriented polymer ribbons woven together and welded on the surface thereof. The fabric therefore is oriented in the longitudinal and transverse directions.

As described above, the lower edge of the front panel, the lower edge of the flanks of the side gussets adjacent the front panel, the lower edge of the flanks of the side gussets adjacent the rear panel, and the lower edge of the rear panel are advantageously offset with respect to each other in a stepped or fan shape such that the layers of the plastic film/fabric laminate folded along the bottom gusset each have a flap that directly abuts the rear panel and is preferably glued to the rear panel. In this manner, the side-gusset bag has a stable bottom face that forms a substantially flat and stable bottom surface following filling of the side-gusset bag. As a result of the use of a plastic film/fabric laminate, the side-gusset bag according to the invention is suitable for large containers and for packaging of bulk goods with high bulk weight.

BRIEF DESCRIPTION OF THE DRAWING

The above and other objects, features, and advantages will become more readily apparent from the following description, reference being made to the accompanying drawing in which:

FIG. 1 is a front elevational view of the front panel of a side-gusset bag lying flat;

FIG. 2 is a rear elevational view of the rear panel of the side-gusset bag shown in FIG. 1;

FIG. 3 is a large-scale view of a detail of the inner surface of the bag of the side-gusset bag shown in FIGS. 1 and 2;

FIG. 4 is a large-scale view of a corner weld seam serving to shape the bottom face the side-gusset bag when filled;

FIG. 4*a* is a large-scale view of the detail indicated at IVA in FIG. 4;

SPECIFIC DESCRIPTION OF THE INVENTION

Figure 5:
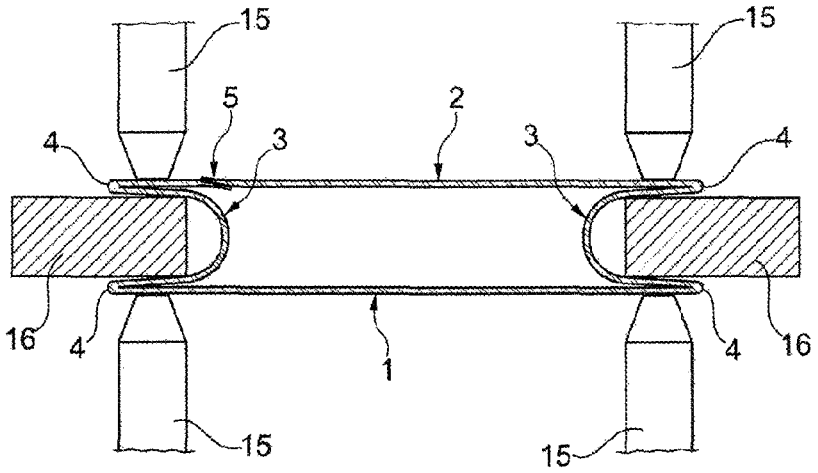
FIG. 5 shows the method of making the corner weld seam shown in FIG. 4.

FIGS. 1 and 2 show a side-gusset bag lying flat, having a front panel 1, a rear panel 2, and side gussets 3 between the front panel and the rear panel and gussets connected to the front panel 1 and rear panel 2 by edge folds 4. Each side gusset 3 is formed by a pair of rectangular flanks 20 and 22 meeting at a center fold and of slightly different lengths as described below. The side-gusset bag is formed from a flat material web by folding. An overlap region 5 on the rear panel 2 in the embodiment is closed by gluing. The side-gusset bag is open at its upper end and can be filled in machines with a loose bulk material. The side-gusset bag has a closed lower end forming a flat bottom face when the side-gusset bag is filled. As described in more detail below with respect to FIGS. 9 and 10. The floor of the bag is formed by a lower end flap 6 of the front panel 1 and by the side gusset flaps 7 between the flap 6 of the front panel 1 and the rear panel 2 and folded onto the rear panel 2 so as to form bottom gussets 8 connected to the rear panel 2.

So that the bottom face is shaped better, when the side-gusset bag is formed, corner weld seams 9 are made that extend at an acute angle from the outer edge fold 4 on the respective longitudinal outer edges of the front or rear panels 1 and 2 toward the bottom gusset 8. The corner weld seams 9 can form an angle between 30° and 60° with the bottom gusset 8. In this embodiment and according to one preferred embodiment of the invention, the corner weld seams 9 each enclose a equilateral-triangular surface, together with the bottom gusset 8 and one edge fold 4 on the side.

The side-gusset bag shown in the drawing is made of a plastic film/fabric laminate. The plastic film/fabric laminate has at least two layers, and comprises a polymer film 10 on the outer surface of the bag and a fabric 11 connected to the polymer film 10 and made of polymer ribbons 12 and 13 on the inner surface of the bag. The polymer film 10 is permanently glued to the fabric 11. The plastic film/fabric laminate is made for example of polyolefinic components.

FIG. 3 shows that the fabric 11 consists of a mesh of polymer ribbons 12 and 13 including longitudinal polymer ribbons 12 and transverse polymer ribbons 13 having a width for example between 2 mm and 5 mm. Here, the polymer ribbons 12 and 13 of the mesh have substantially the same width longitudinally of the bag and the transverse direction of the bag.

The fabric surface on the inner surface of the bag cannot be easily welded. High weld temperatures would be required, and the risk would exist that orientations in the polymer ribbons 12 and 13 would be destroyed. The corner weld seams 9 are generated according to the invention by ultrasound welding, and have a structure produced by ultrasound welding with a grid pattern of a two-dimensional array of weld points 14. The weld points 14 connect the fabric surface of the side gussets 3 on the inner surface of the bag with the adjacent fabric surface of the front panel 1 or rear panel 2. The scope of the invention also includes a system in which the structure of the corner weld seam generated by ultrasound welding consists of lines of weld points that extend for example parallel to, or across each other.

The method of making the corner weld seams 9 by ultrasound welding is shown in FIG. 5. High-frequency alternating current is produced by a generator and transmitted to an ultrasound converter that generates an ultrasonic vibration therefrom. The high-frequency mechanical oscillations of a sonotrode 15 are transmitted under pressure to the polymer layers being connected. The oscillations in ultrasound welding cause molecular friction and boundary surface friction in the joint zone. In the process, the heat needed for the weld is created and the polymer material is plasticized at the weld points 14. According to FIG. 5, counter bearings 16 for the sonotrode 15 engage laterally with the expanded side gussets 3. The ultrasound seal has the advantage that the welding times are short, and thermal energy is limited as much as possible to the contact regions such that other laminate regions, and particularly the oriented polymer ribbons 12 and 13 of the fabric 11, are exposed to lower heat stress.

The corner weld seams 9 each have a width as shown in FIG. 4, between 2 mm and 10 mm with a grid pattern advantageously of 10 to 500 weld points per surface area of 100 $mm^2$. Here, the corner weld seam 9 is about 4 mm wide and is composed of about 100 weld points per surface area of 100 $mm^2$. FIG. 4 shows that the weld points 14 of the corner weld seams 9 are on parallel lines 17 oriented at an angle $\beta$ of 45° to the longitudinal extension of the corner weld seams 9. At least three weld points 14 are on each line 17, next to each other with equidistant spacing.

Figure 8:
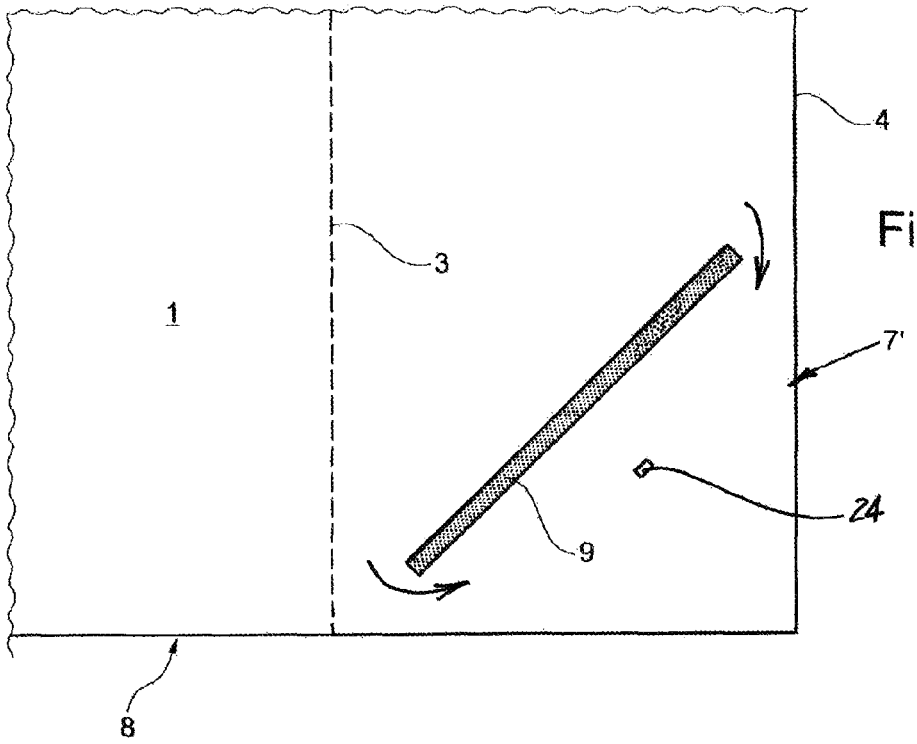
FIG. 8 shows a variant of the subject matter as shown in FIG. 4.

In the embodiment of FIG. 8, a ventilation hole 24 is in at least one triangular bag flap 7' bounded by a corner weld seam 9. An exchange of air is ensured between the bag flap 7' formed with the ventilation hole 24 and the interior fill space of the side-gusset bag. The exchange of air is indicated by arrows. Here, the exchange of air is possible because the corner weld seam 9 maintains a space between the bottom gusset 8 and the edge fold 4 on the longitudinal side of the bag. As an alternative or in addition thereto, the corner weld seam can for example be discontinuous in order to ensure or facilitate the exchange of air between the triangular bag flap 7' and the fill space of the side-gusset bag.

Figure 6:
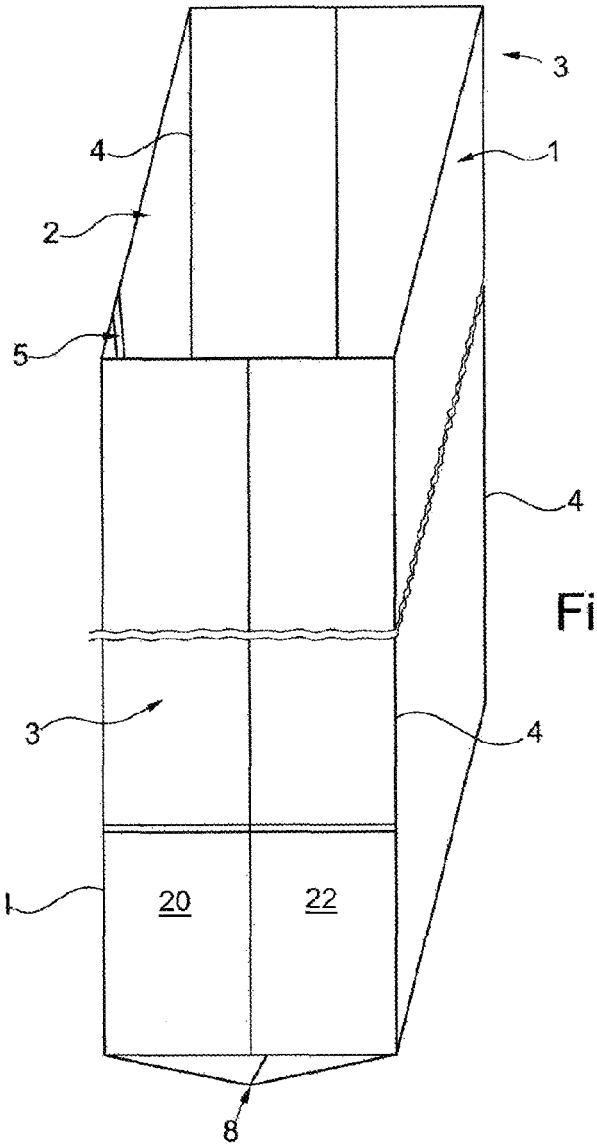
FIG. 6 shows a side-gusset bag closed following the filling thereof, resulting in a package.

The corner weld seams 9 provide a good base shape during filling of the side-gusset bag. After filling and the closure of its upper end, the side-gusset bag forms a substantially parallepipedal package with a flat, stable bottom face, as shown in FIG. 6.

Figure 7:
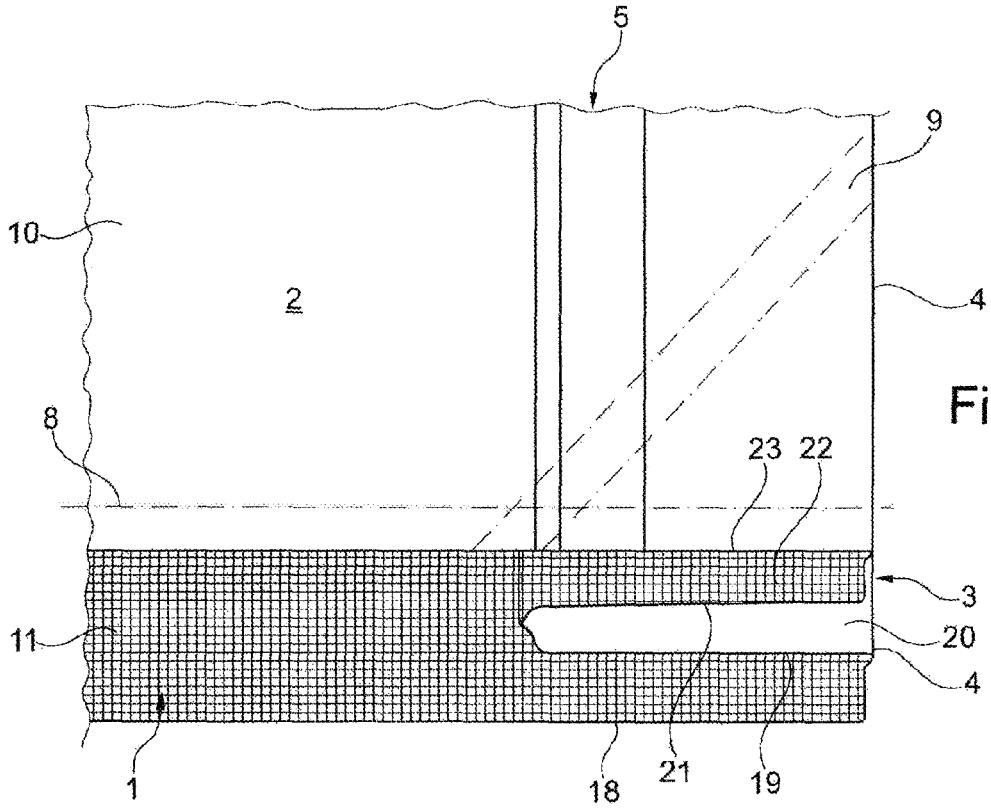
FIG. 7 shows the profile of a cut edge of the film layers of a side gusset tube prior to gluing of the film layers to form a bottom face.
Figure 9:
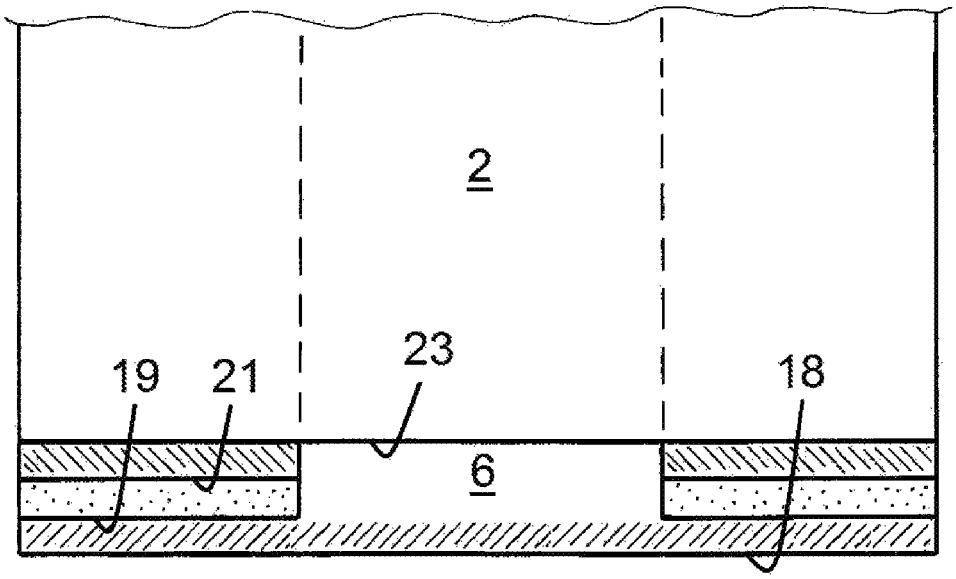
FIG. 9 is a view from the rear of a lower region the tubular workpiece prior to formation of the bag floor.
Figure 10:
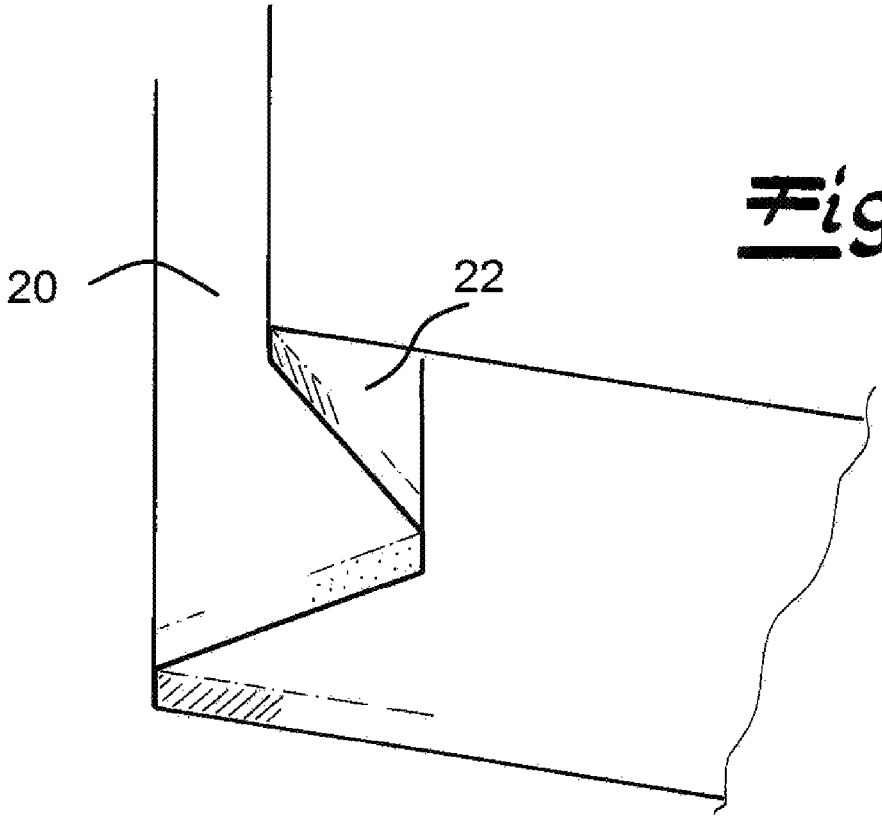
FIG. 10 is a perspective view of the structure of FIG. 9 with the tubular workpiece somewhat spread to show more detail.

The side-gusset bag made of a plastic film/fabric laminate can be used for the package of loose bulk goods such as pelletized animal feed, litter for animals, or similar materials, and is suitable as a bag particularly for large packages that have a significant filled volume and a significant filled weight. In addition to the fact that the package has a well-shaped flat bottom face as a result of the corner weld seams 9, the bottom face must also be able to bear a great load during filling and during handling of the bag. Because the fabric surfaces on the inner surface of the bag are not capable of welding, the material layers are preferably glued to each other. As regards the permanent glued bond, it is advantageous if the film layers being glued to each other to form a bottom face have an edge profile with the shape shown in FIG. 7. FIGS. 7 and 9 show a view toward the front of the rear panel 2 and FIG. 10 a similar view but with the structure spread to show more detail. A lower edge 18 of the lower end flap 6 of the front panel 1, a lower edge 19 of the flank 20 of each side gusset 3 adjacent the front panel 1, a lower edge 21 of each flank 22 adjacent the rear panel 2, and the lower edge 23 of the rear panel 2 are offset from one other in a fan shape, that is stepped so as to expose a lower edge region or strip of each flank 20 and 22 and of the end flap 6.

Adhesive is applied to the thus exposed edge regions as shown by hatching and stippling in FIG. 9, then they are folded over onto the outer face of the back panel 2 and adhered there. Finally the diagonal weld 9 shown in FIG. 8 and, if desired, the vent hole 24 can be formed. The result is a robust floor for the bag that can be manufactured with relative ease.

We claim:

1. A side-gusset bag made of a plastic film/fabric laminate, the bag comprising:

a front panel formed of the laminate, the laminate having a polymer film on an outer surface of the bag and a mesh fabric connected to the polymer film and made of crossing polymer ribbons on an inner surface of the bag, the ribbons having a width between 2 mm and 5 mm;

a rear panel also formed of the laminate;

side gussets between the front panel and the rear panel, each formed of the laminate with a pair of flanks meeting at a center fold, and each connected to the front panel and rear panel at respective longitudinally extending edge folds;

lower end flaps on the front panel and on the flanks between the front panel and the rear panel having respective lower edges, a the lower edge of the lower end flap of the front panel, the lower edges of the end flaps of the flanks of the side gussets adjacent the front panel, the lower edges of the end flaps of the flanks of the side gussets adjacent the rear panel, and a lower edge of the rear panel being offset in steps longitudinally with respect to each other;

glue on the lower end flaps of the flanks and the lower end flap of the front panel, such that when folded rearward along a lower edge of the rear panel, the glue on these lower end flaps directly engages a rear face of the rear panel and secures the lower end flaps to the rear panel to form a bottom gusset; and corner weld seams of a width between 2 mm and 10 mm, created by ultrasonic welding with a two-dimensional grid pattern of 10 to 500 weld points per 100 $mm^2$, bonding the fabric of the side gussets on the inner surface of the bag to the adjacent inner surfaces of the front panel or rear panel and extending at an acute angle toward the bottom gusset.

2. The side-gusset bag defined in claim 1, wherein the corner weld seams extend to the bottom gusset or near to the bottom gusset.

3. The side-gusset bag defined in claim 1, wherein the corner weld seams together with the bottom gusset and one edge fold on the side enclose respective equilaterally triangular regions.

4. The side-gusset bag defined in claim 3, wherein a ventilation hole is in at least one triangular bag flap bounded by a corner weld seam, and an exchange of air is ensured between the bag flap configured with the ventilation hole and a fill space of the side-gusset bag.

5. The side-gusset bag defined in claim 1, wherein the polymer ribbons of the mesh extending longitudinally of the bag and the polymer ribbons extending transversely of the bag have substantially the same width.

6. The side-gusset bag defined in claim 1, wherein the weld points of the corner weld seams are arrayed in parallel lines oriented at an angle of 45° with respect to a longitudinal extension of the corner weld seams, and at least three weld points are on each line at equidistant spacings next to each other.

* * * * *